US007517233B2

(12) United States Patent
Xiang

(10) Patent No.: US 7,517,233 B2
(45) Date of Patent: Apr. 14, 2009

(54) ELECTRICAL CONNECTOR WITH IMPROVED FASTENER

(75) Inventor: Xing-Hai Xiang, Kunshan (CN)

(73) Assignee: Hon Hai Precision Ind. Co., Ltd., Taipei Hsien (JP)

( * ) Notice: Subject to any disclaimer, the term of this patent is extended or adjusted under 35 U.S.C. 154(b) by 0 days.

(21) Appl. No.: 11/890,867

(22) Filed: Aug. 8, 2007

(65) Prior Publication Data

US 2008/0038958 A1 Feb. 14, 2008

(30) Foreign Application Priority Data

Aug. 8, 2006 (CN) ..... 200620076282.4

(51) Int. Cl.
*H01R 12/20* (2006.01)

(52) U.S. Cl. ..... 439/79; 439/567

(58) Field of Classification Search ..... 439/79, 439/362, 607, 567, 569–571
See application file for complete search history.

(56) References Cited

U.S. PATENT DOCUMENTS 5,344,342 A * 9/1994 Briones ..... 439/620.12
5,851,125 A * 12/1998 Hsu et al. ..... 439/541.5
6,293,822 B1 * 9/2001 Zhu et al. ..... 439/567
7,097,467 B2 * 8/2006 Chen ..... 439/79
7,128,582 B2 * 10/2006 Fang et al. ..... 439/79

* cited by examiner

*Primary Examiner*—Khiem Nguyen
(74) *Attorney, Agent, or Firm*—Wei Te Chung

(57) ABSTRACT

An electrical connector (100) includes an insulative housing (1), a plurality of contacts (2) retained in the insulative housing (1), a metal shell (3) partially enclosing the insulative housing, a pair of board locks (4) and a pair of fasteners (5) for assembling the board locks (4) and the metal shell (3) onto the insulative housing. The fastener (5) includes a resisting portion (51) abutting against the metal shell and a rivet portion (53) extending through the board lock. The rivet portion (53) is hollow to form a recess (531) therein and defines a plurality of notches (530) to separate the rivet portion (53) into several discontinuous parts which is riveted to abut against the board lock.

13 Claims, 5 Drawing Sheets

ELECTRICAL CONNECTOR WITH IMPROVED FASTENER

BACKGROUND OF THE INVENTION

1. Field of the Invention

The present invention relates to an electrical connector, and more particularly to an electrical connector with improved fastener.

2. Description of the Prior Art

U.S. Pat. No. 6,679,727 B1 discloses a conventional electrical connector which comprises an insulative housing, a plurality of terminals received in the insulative housing, a shell partially enclosing the housing, a pair of board locks and a pair of fasteners for assembling the board locks onto the housing. Each fastener has a base plate and a hollow cylinder extending from the base plate. The hollow cylinder extends through a through hole of the board lock with the base plate to abut against the board lock on a rear side of the insulative housing. The hollow cylinder further comprises a rivet portion on a distal end thereof. The rivet portion is stamped outwardly to riveted to abut against a front surface of the shell on a front side of the insulative housing so that the electrical connector is assembled. However, since the rivet portion is continuous along its circumference, the rivet portion is avulsed difficultly to riveted to abut against the shell in manufacture. Besides, under the riveted process, the avulsion of the continuous rivet portion might be anomalous so that the appearance of the electrical connector is not good enough.

Hence, an improved electrical connector is needed to solve the problem above.

BRIEF SUMMARY OF THE INVENTION

A main object of the present invention is to provide an electrical connector with improved fastener for easy assembly thereof.

In order to attain the object above, an electrical connector includes an insulative housing, a plurality of contacts retained in the insulative housing, a metal shell partially enclosing the insulative housing, a pair of board locks and a pair of fasteners for assembling the board locks and the shell onto the insulative housing. The insulative housing defines a pair of apertures on lateral sides thereof. The shell defines a pair of through holes corresponding to the apertures. Each board lock defines a bore therethrough corresponding to the aperture. The through holes and the bores are positioned on opposite sides of the apertures for the fasteners extending therethrough. Each fastener extends through the through hole and through the aperture and the bore, and comprises a resisting portion abutting against the shell and a rivet portion extending beyond the bore. The rivet portion is hollow to form a recess therein and defines a plurality of notches in communication with the recess to separate the rivet portion into several discontinuous parts. When in riveted process, the discontinuous parts of the rivet portion are easy to be riveted to abut against corresponding board lock, thereby facilitating the manufacture of the electrical connector and improving the appearance of the electrical connector as well.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
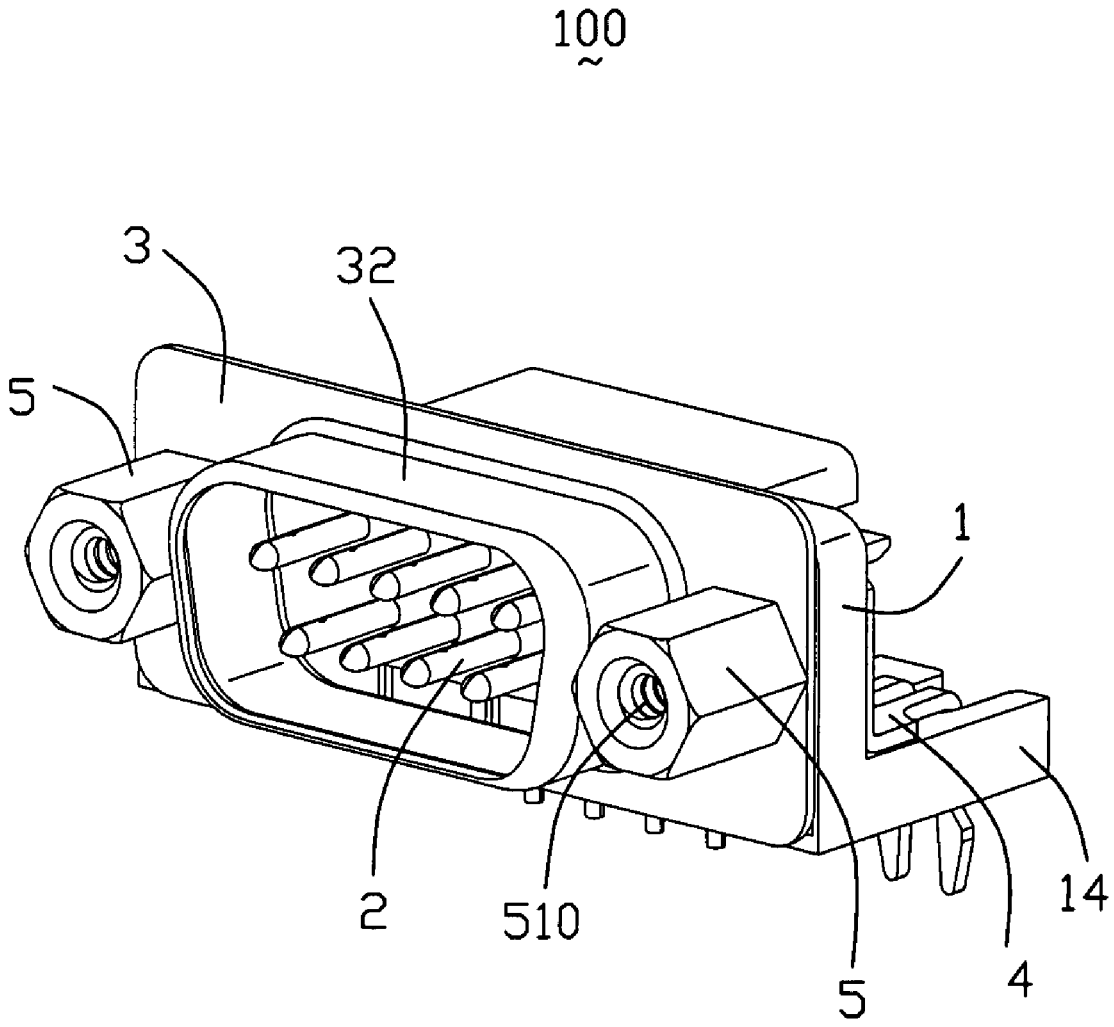
FIG. 1 is a perspective view of an electrical connector before riveted process according to a preferred embodiment of the present invention.

Referring to FIGS. 1-5, an electrical connector 100 includes an insulative housing 1, a plurality of contacts 2 retained in the insulative housing 1, a metal shell 3 partially enclosing the insulative housing 1, a pair of board locks 4 and a pair of fasteners 5 for assembling the board locks 4 and the metal shell 3 onto the insulative housing 1.

Figure 4:
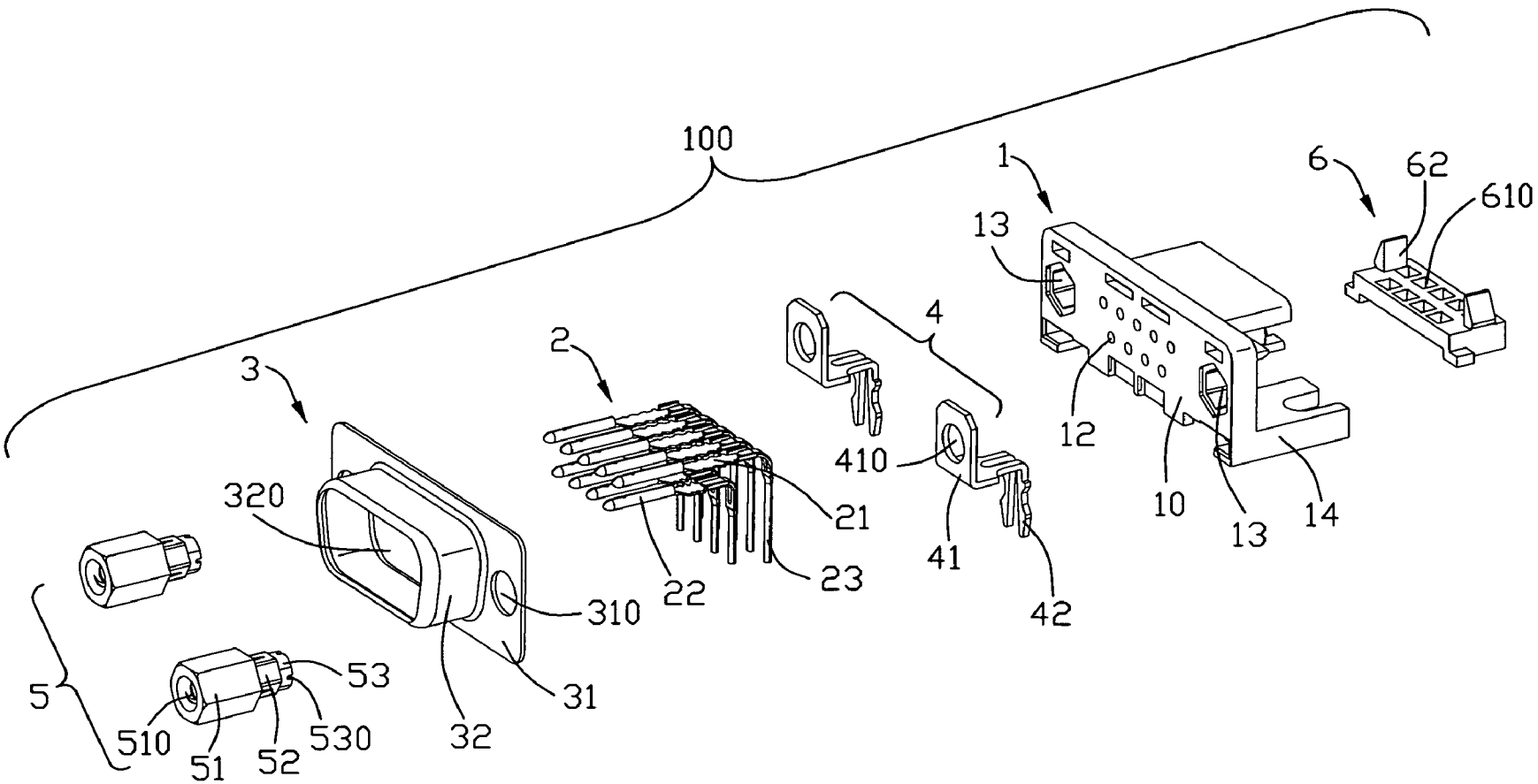
FIG. 4 is an exploded view of the electrical connector.
Figure 5:
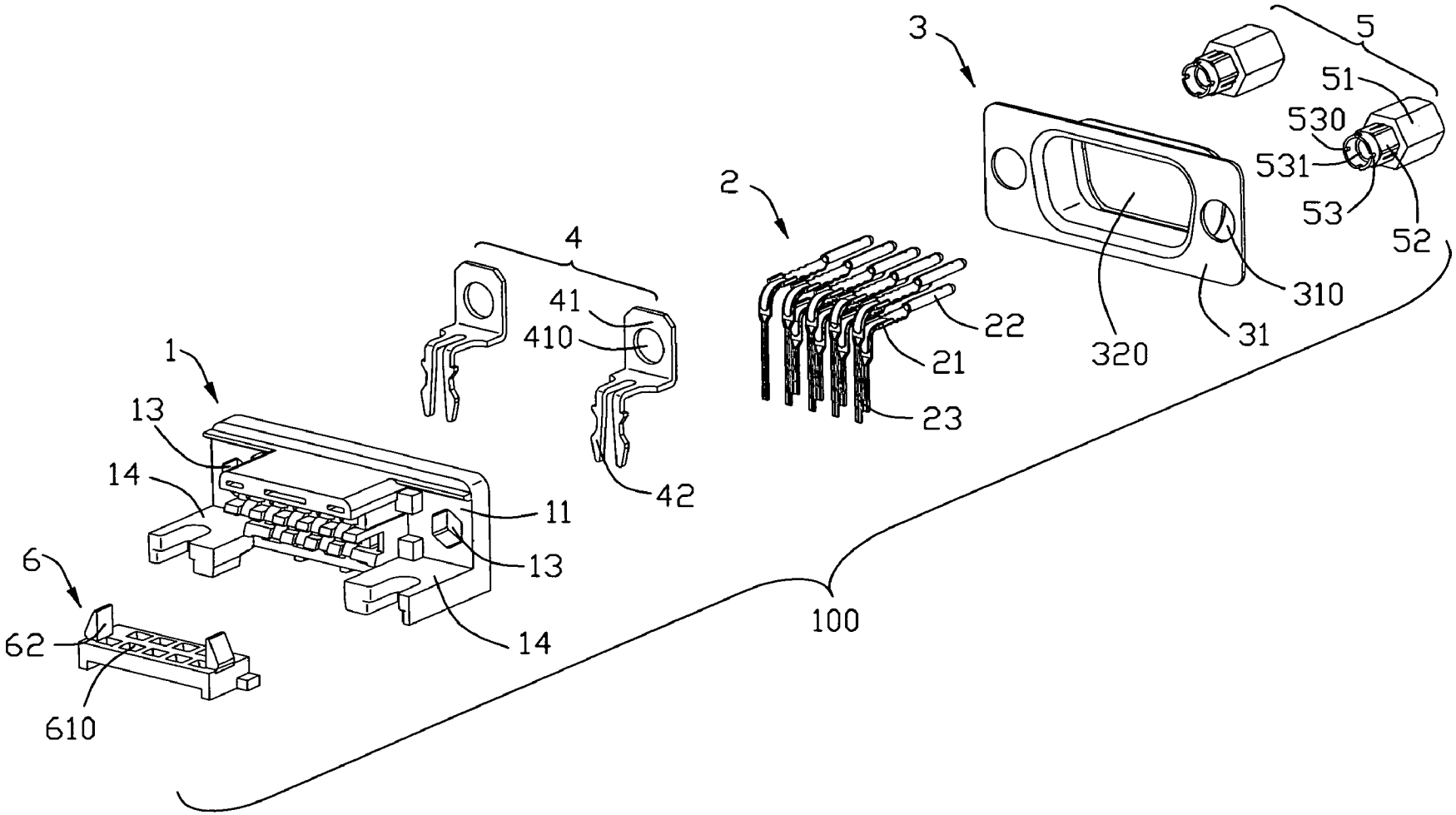
FIG. 5 is similar to FIG. 4, but viewed from another aspect.

Referring to FIGS. 4-5, the insulative housing 1 comprises a flat front surface 10, a rear surface 11 opposite to the front surface 10 and a plurality of passageways 12 extending through the front and rear surfaces 10, 11 for receiving the contacts 2. A pair of polygonal apertures 13 are defined therethrough on lateral sides of the insulative housing 1. A pair of mounting protrusions 14 extend from a bottom edge of the insulative housing 1 for mounting the electrical connector 100 to a PCB (not shown).

The contacts 2 are assembled from the rear surface 11 to the insulative housing 1. Each contact 2 comprises a retaining portion 21 received in the passageways 12 of the insulative housing 1, a column-shaped contact portion 22 protruding from the front surface 10 and a tail portion 23 to be soldered to the PCB.

The metal shell 3 comprises a flat mating portion 31 to be attached to the front surface 10 of the insulative housing 1 and a D-shaped projection 32 protruding forwardly from the mating portion 31. The mating portion 31 defines a pair of through holes 310 on lateral sides thereof corresponding to the polygonal apertures 13. The projection 32 is hollow to define a chamber 320 therein for the contact portions 22 of the contacts 2 extending thereinto and for receiving a mating connector (not shown).

Each board lock 4 comprises a base 41 and a pair of separated pawls 42 bending from the base 41 to retain the electrical connector 100 on the PCB. The base 41 is attached to the rear surface 11 of the insulative housing 1. The base 41 defines a bore 410 therethrough for receiving the fastener 5 to fix the board lock 4 onto the insulative housing 1.

Figure 3:
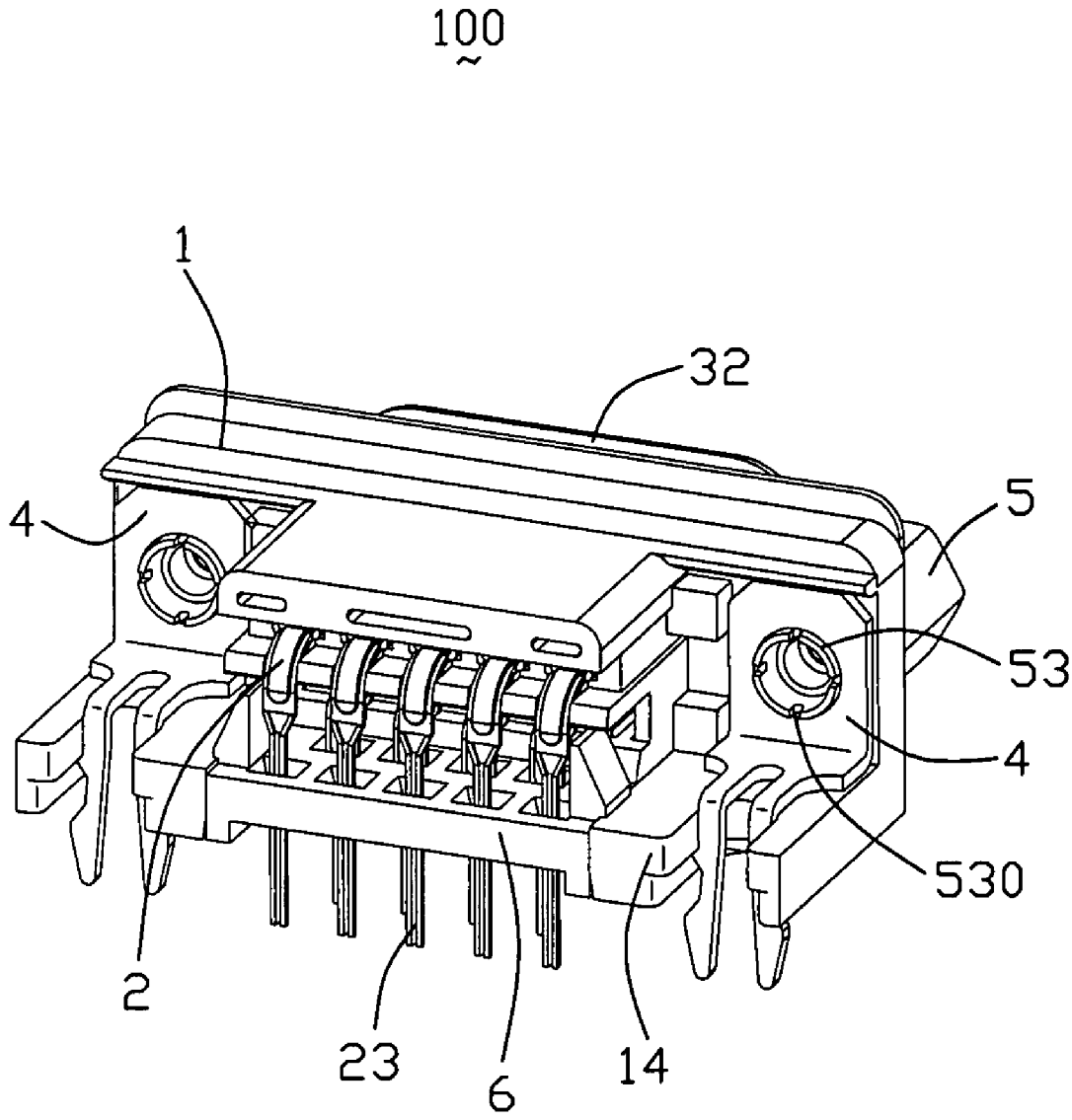
FIG. 3 is similar to FIG. 2, but viewed from another aspect.

Referring to FIGS. 4-5, each fastener 5 is nut in the preferred embodiment and comprises a middle portion 52 retained in the polygonal apertures 13, a resisting portion 51 abutting against the mating portion 31 of the shell 3 and a rivet portion 53 to be riveted to abut against the base 41 of the board lock 4. The rivet portion 53 is contractive relative to the middle portion 52 which is also contractive to the resisting portion 51. In other words, the resisting portion 51 is larger than the middle portion 52 while the rivet portion 53 is smaller than the middle portion 52. The resisting portion 51 defines a plurality of inner screw threads 510 therein. The middle portion 52 is polygonal corresponding to the polygonal apertures 13 so that the fastener 5 can't be rotatable with respect to the insulative housing 1. It is obvious to those of ordinary skill in the art that the apertures 13 and the middle portion 52 can comprise at least one matable surface, respectively to prevent any rotatability therebetween. The rivet portion 53 is hollow to form a recess 531 therein and defines a plurality of notches 530 in communication with the recess 531. The plurality of notches 530 positioned along girth of the rivet portion 53 separate the rivet portion 53 into several discontinuous parts. In assembly, Each fastener 5 extends through the corresponding through hole 310 of the shell 3 and through the corresponding aperture 13 and the bore 410 of the board lock 4. The rivet portion 53 extends beyond the bore 410 as shown in FIG. 3. When in riveted process, the discontinuous parts of the rivet portion 53 are easy to be riveted to abut against the base 41 of the board lock 4, thereby facilitating the manufacture of the electrical connector 100 and improving the appearance of the electrical connector 100 as well.

Figure 2:
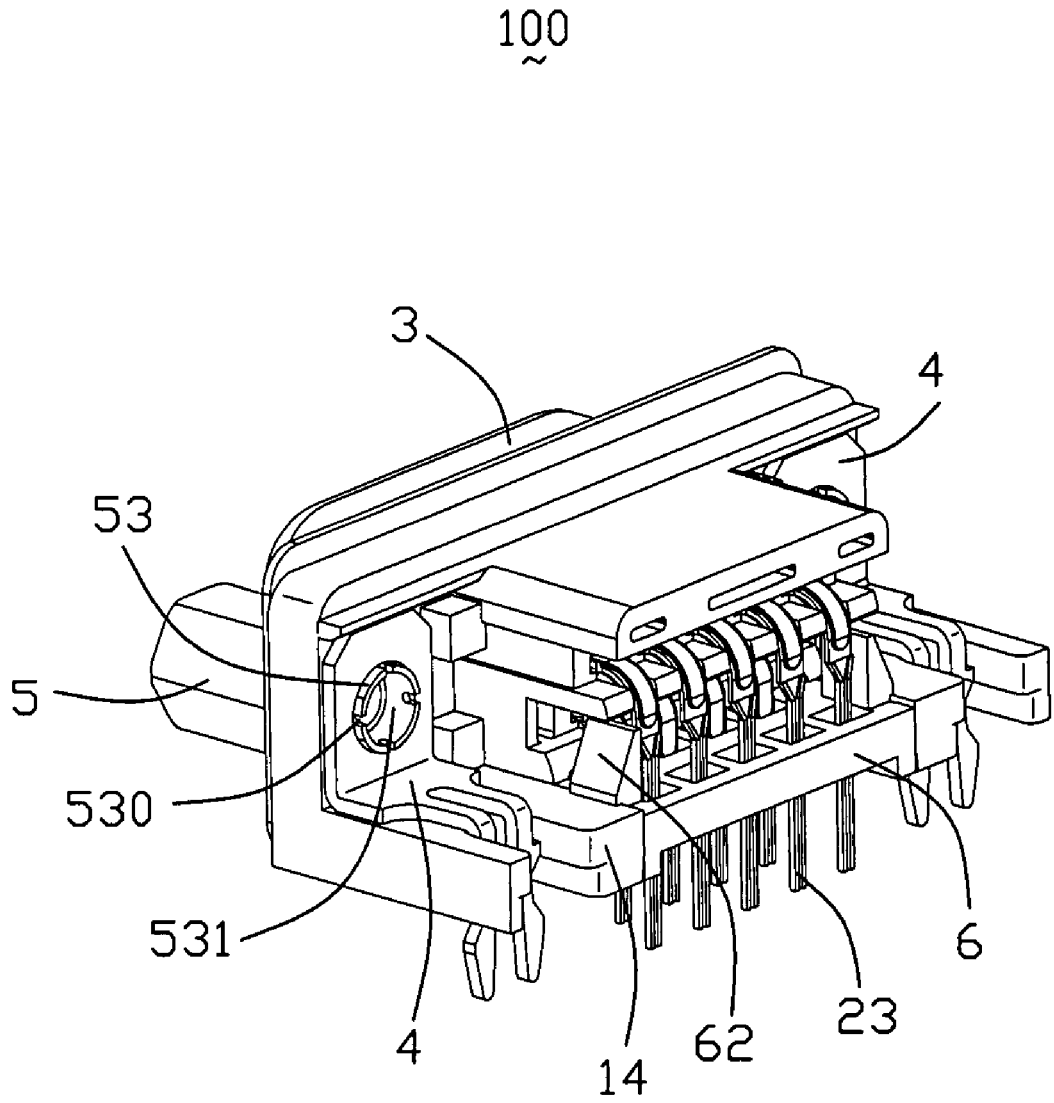
FIG. 2 is similar to FIG. 1, but viewed from another aspect.

In order to prevent the tail portions 23 of the contacts 2 from being deformed, a spacer 6 is provided with a plurality of through holes 610 for the tail portions 23 extending therethrough and a pair of hooks 62 for retaining the spacer 6 to the mounting protrusions 14 as shown in FIGS. 2-3.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing defining an aperture therethrough;

a plurality of contacts retained in the insulative housing;

a shell defining a through hole corresponding to one side of the aperture;

a board lock comprising a base with a bore defined through the base, the bore being corresponding to the other side of the aperture; and a fastener extending through the through hole and through the aperture and the bore, the fastener comprising a resisting portion abutting against the shell and a rivet portion extending beyond the bore, the rivet portion being hollow to form a recess therein and defining a plurality of notches in communication with the recess to separate the rivet portion into several discontinuous parts, and wherein the discontinuous parts of the rivet portion are riveted to abut against the base of the board lock.

2. The electrical connector according to claim 1, wherein the fastener comprises a middle portion connecting the resisting portion and the rivet portion, the middle portion being received in the aperture.

3. The electrical connector according to claim 2, wherein the middle portion is contractive with respect to the resisting portion.

4. The electrical connector according to claim 2, wherein the rivet portion is contractive with respect to the middle portion.

5. The electrical connector according to claim 2, wherein the middle portion and the aperture comprise at least one matable surface, respectively, to prevent rotatability therebetween.

6. The electrical connector according to claim 1, wherein the plurality of notches extend along girth of the rivet portion.

7. The electrical connector according to claim 1, wherein the shell is stamped from metal sheet and partially enclosing a front surface of the insulative housing, the shell comprising a flat mating portion to be attached to the front surface of the insulative housing and a D-shaped projection protruding from the mating portion.

8. The electrical connector according to claim 1, wherein the fastener is nut and the resisting portion defines a plurality of inner screw threads recessed therein.

9. An electrical connector comprising:

an insulative housing defining one through aperture;

a plurality of contacts disposed in the housing;

a metallic shell covering one side of the housing and forming therein at least one through hole in alignment with the through aperture;

a board lock having a board locking leg and a housing attaching section located on the other side of the housing;

a fastener having a resisting portion seated upon the shell with internal threads therein, a middle portion extending from the resisting portion through the through hole and the through aperture, and rivet portion located behind the middle portion; wherein the rivet portion defines a plurality of notches to divide said rivet portion into several discontinuous parts circumferentially, and said discontinuous parts of the are riveted to abut against the housing attaching section.

10. The electrical connector according to claim 9, wherein the middle portion is contractive with respect to the resisting portion, and the rivet portion is contractive with respect to the middle portion.

11. The electrical connector according to claim 9, wherein the plurality of notches extend along girth of the rivet portion.

12. The electrical connector according to claim 9, wherein the rivet portion is riveted radially outwardly for abutment against the housing attaching section of the board lock.

13. The electrical connector according to claim 9, wherein the housing attaching section of the board lock defines a bore through which the rivet portion extends.

* * * * *